US007117978B2

(12) United States Patent
Kaczmarek et al.

(10) Patent No.: US 7,117,978 B2
(45) Date of Patent: Oct. 10, 2006

(54) DAMPENING DEVICE FOR AN ELEVATOR COMPENSATING CABLE AND ASSOCIATED SYSTEM AND METHOD

(75) Inventors: Didier Kaczmarek, Rocky Mount, NC (US); Billy Roy Parker, Rocky Mount, NC (US); Geoffrey Todd Vaughn, Durham, NC (US)

(73) Assignee: Draka Elevator Products, Inc., Rocky Mount, NC (US)

( * ) Notice: Subject to any disclaimer, the term of this patent is extended or adjusted under 35 U.S.C. 154(b) by 56 days.

(21) Appl. No.: 10/915,245

(22) Filed: Aug. 10, 2004

(65) Prior Publication Data

US 2005/0133312 A1 Jun. 23, 2005

Related U.S. Application Data

(60) Provisional application No. 60/494,501, filed on Aug. 12, 2003.

(51) Int. Cl.
*B66B 1/00* (2006.01)

(52) U.S. Cl. ..... 187/276; 187/251; 187/277; 187/351

(58) Field of Classification Search ..... 187/241, 187/246, 247, 250–251, 254, 262, 267, 389, 187/390–1; 174/42
See application file for complete search history.

(56) References Cited

U.S. PATENT DOCUMENTS

| | | | | |
|---|---|---|---|---|
| 2,537,075 | A * | 1/1951 | Margles | 187/264 |
| 3,810,529 | A | 5/1974 | Tosato et al. | |
| 3,882,968 | A | 5/1975 | Suozzo | |
| 5,103,937 | A | 4/1992 | Robertson | |
| 5,886,308 | A * | 3/1999 | Ericson et al. | 187/393 |
| 6,488,125 | B1 * | 12/2002 | Otsuka et al. | 187/264 |
| 2003/0075389 | A1 | 4/2003 | Otsuka et al. | |

FOREIGN PATENT DOCUMENTS

| | | | |
|---|---|---|---|
| JP | 51-112048 | A | 10/1976 |
| JP | 1-118967 | A | 5/1989 |
| JP | 4-217579 | A | 8/1992 |
| JP | 5-178564 | A | 7/1993 |
| JP | 6-64863 | A | 3/1994 |
| JP | 6-211463 | A | 8/1994 |
| JP | 9-315728 | A2 | 12/1997 |
| JP | 11-255452 | A | 9/1999 |

* cited by examiner

*Primary Examiner*—Kathy Matecki
*Assistant Examiner*—Stefan Kruer
(74) *Attorney, Agent, or Firm*—Alston & Bird LLP

(57) ABSTRACT

A dampening device for a compensating cable operably engaged with an elevator car is provided, wherein the compensating cable includes two linear portions connected by an arcuate portion. A first guide including at least one roller member is disposed within the arcuate portion and is configured to dampen oscillation of the compensating cable. At least one sensor device is disposed within the arcuate portion and is capable of operably engaging at least one of the compensating cable and the at least one roller member to sense an entanglement condition of the compensating cable. In some instances, at least one sensor device is disposed outside the arcuate portion, in addition to or instead of the at least one sensor within the arcuate portion, and capable of operably engaging the compensating cable to sense a suspension rope stretch condition. An associated system and method are also provided.

28 Claims, 4 Drawing Sheets

Figure 1:
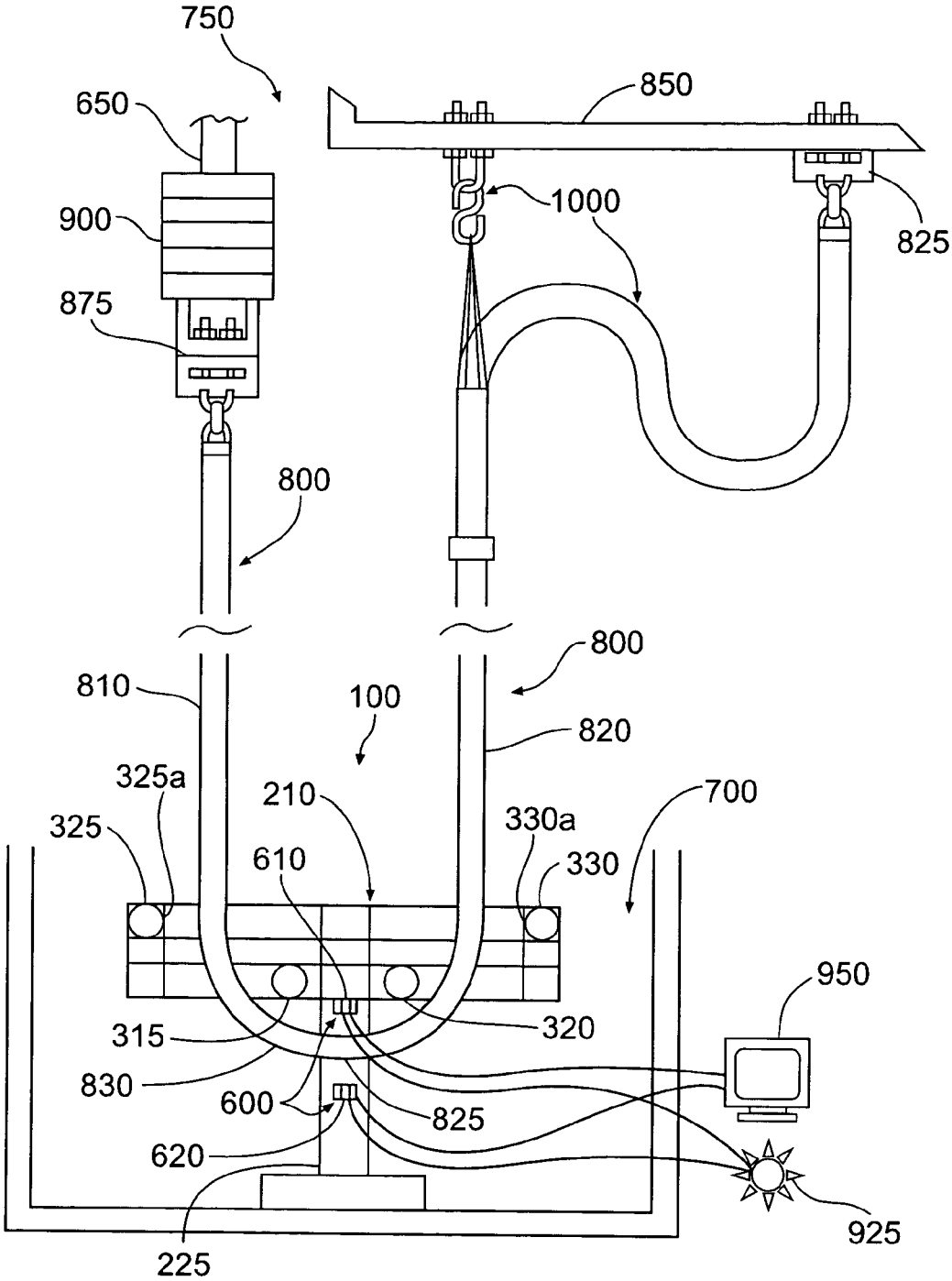

DAMPENING DEVICE FOR AN ELEVATOR COMPENSATING CABLE AND ASSOCIATED SYSTEM AND METHOD

CROSS-REFERENCE TO RELATED APPLICATIONS

This application claims the benefit of U.S. Provisional Application No. 60/494,501, filed Aug. 12, 2003.

BACKGROUND OF THE INVENTION

1. Field of the Invention

The present invention relates to an elevator having a compensating cable and, more particularly, to a dampening device for a compensating cable operably engaged with an elevator car, capable of dampening oscillation of the compensating cable and indicating an abnormal condition thereof, and associated system and method.

2. Description of Related Art

An elevator car installation typically uses a compensating cable arrangement, as will be appreciated by one skilled in the art. Such a compensating cable is generally very flexible and can be hung at very long lengths in an elevator hoistway. Because the compensating cable is attached to the elevator car and a counterweight, which move vertically and opposite each other, the cable is susceptible to oscillations and/or swaying during operation of the elevator. The oscillations of the cable are typically of the greatest magnitude and the most evident in the pit area at the bottom of the elevator hoistway, which is where the cable forms a loop. The oscillations of the cable may pose a problem in the pit when the cable moves and sways near equipment therein. More particularly, the oscillations and/or swaying of the cable can cause the loop to become entangled with the pit equipment or to possibly fall outside the influence of one or more dampening devices intended to dampen the motion of the cable. Thus, during operation, the compensating cable may be at risk of becoming entangled and/or overloaded, and thereby possibly raising operational and safety concerns.

One compensating cable installation method requires a safety loop to be incorporated into the compensating cable. The safety loop may be, for example, located underneath the elevator car where a loop of the compensating cable is supported from the car with a deformable S-hook. The S-hook functions as a mechanical safety link such that, should the compensating cable become entangled and/or overloaded, the S-hook yields and the slack or excess length of cable forming the loop is released from the elevator car. One intended effect of such a configuration is that the released excess cable will allow the cable to untangle itself, thereby reducing the risk of damage to the cable should it become severely overloaded. However, if the elevator car is moving downward and the cable happens to become entangled in the pit or with pit equipment, the portion of the cable underneath the counterweight will tend to become overloaded, while the portion of the cable underneath the car will be slack. As such, the safety loop may not work properly in that instance.

Thus, there exists a need for a dampening device for shallow elevator pits that will not transfer or apply torsion or other forces to the compensating cable, but is capable of dampening the sway of the cable resulting from centrifugal forces and oscillations during operation. Such a dampening device should be operable with different cable configurations, such as a round compensation cable or a flat compensation cable, should contain the cable loop in its proper position, and should properly guide the cable so as to prevent potential entanglements. The dampening device should desirably provide an alternative to or supplement for the compensating cable safety loop, by detecting an abnormal or unsafe compensating cable condition and, as a result, indicating the condition and/or stopping operation of the elevator before damage and/or injury occur. More particularly, such a device should be capable of signaling or warning of an unsafe compensation cable loop condition such as, for example, when the loop in the pit is hanging too low from suspension rope stretch or when the loop is too high due to entanglement of the cable.

BRIEF SUMMARY OF THE INVENTION

The above and other needs are met by the present invention which, in one embodiment, provides a dampening device for a compensating cable operably engaged with an elevator car. Such a compensating cable has two linear portions connected by an arcuate portion. The device comprises a first guide, including at least one roller member disposed within the arcuate portion. The first guide is configured to dampen oscillation of the compensating cable. At least one sensor device is disposed within the arcuate portion and is configured to be capable of operably engaging the compensating cable and/or the at least one roller member so as to sense an entanglement condition of the compensating cable.

Another advantageous aspect of the present invention comprises an elevator system. Such a system includes an elevator car, a counterweight, and a compensating cable operably engaged therebetween, wherein the compensating cable has two linear portions connected by an arcuate portion. A dampening device includes a first guide, having at least one roller member, disposed within the arcuate portion, wherein the first guide is configured to dampen oscillation of the compensating cable. At least one sensor device is disposed within the arcuate portion and is configured to be capable of operably engaging the compensating cable and/or the at least one roller member so as to indicate an entanglement condition of the compensating cable.

Still another advantageous aspect of the present invention comprises a method for guiding a compensating cable operably engaged with an elevator car, wherein the compensating cable has two linear portions connected by an arcuate portion. First, the compensating cable is guided about a first guide disposed within the arcuate portion. The first guide includes at least one roller member and is configured to dampen oscillation of the compensating cable. Subsequently, an entanglement condition of the compensating cable is detected with at least one sensor device disposed within the arcuate portion and configured to be capable of operably engaging at least one of the compensating cable and the at least one roller member.

Yet still other advantageous embodiments of the present invention comprise a dampening device for a compensating cable operably engaged with an elevator car. Such a compensating cable has two linear portions connected by an arcuate portion. The device comprises a first guide, including at least one roller member disposed within the arcuate portion. The first guide is configured to dampen oscillation of the compensating cable. At least one sensor device is disposed outside the arcuate portion and is configured to be capable of operably engaging the compensating cable so as to sense a suspension rope stretch condition. The at least one sensor outside the arcuate portion may be provided in addition to or instead of the at least one sensor device within the arcuate portion.

Thus, embodiments of the present invention meet the above and other needs and provide distinct advantages as discussed herein in further detail.

BRIEF DESCRIPTION OF THE SEVERAL VIEWS OF THE DRAWING(S)

Figures 2A, 2B:
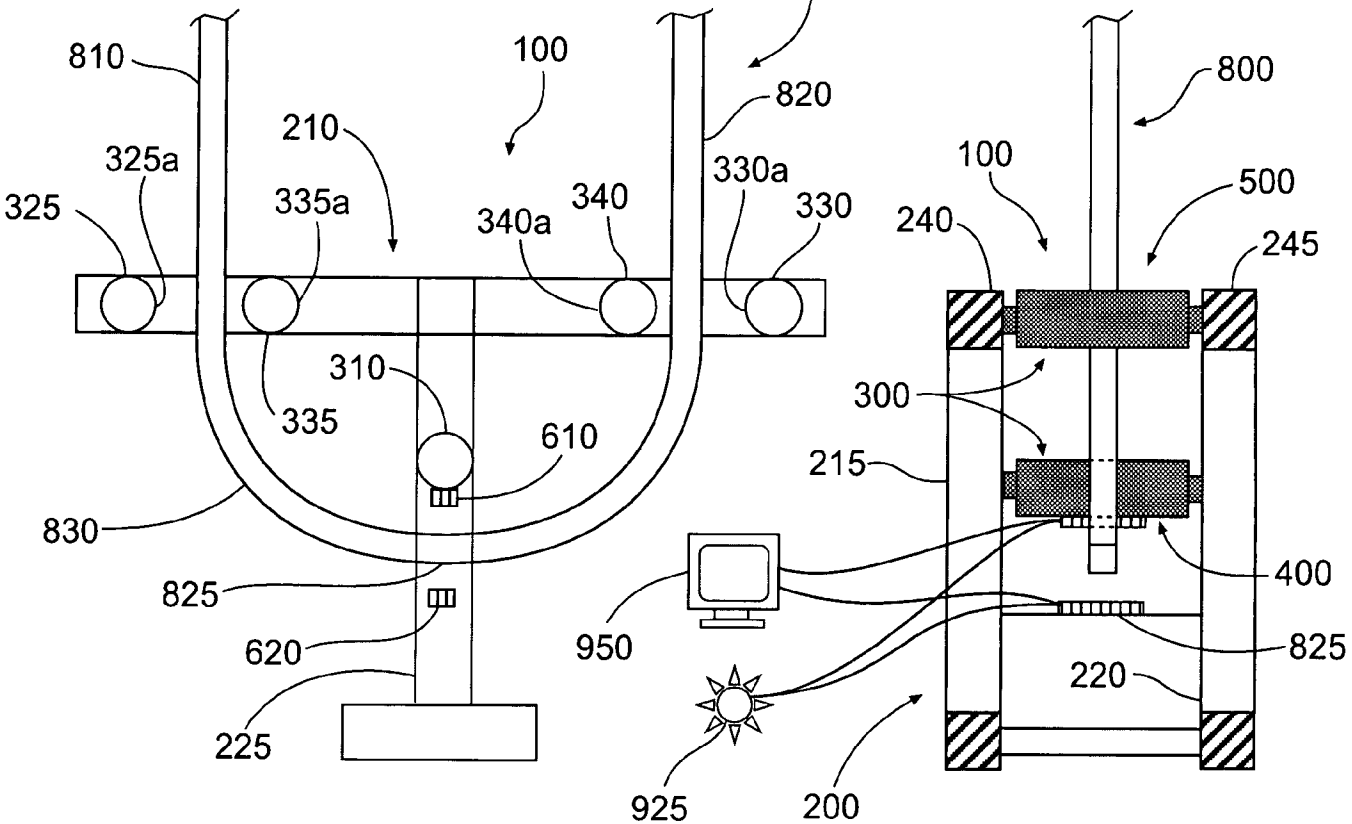
Figure 3B:
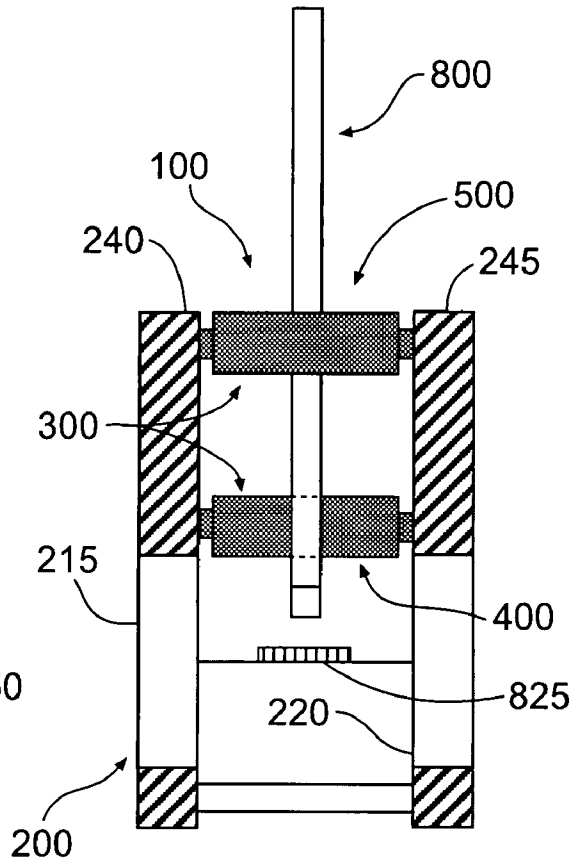
Figure 3A:
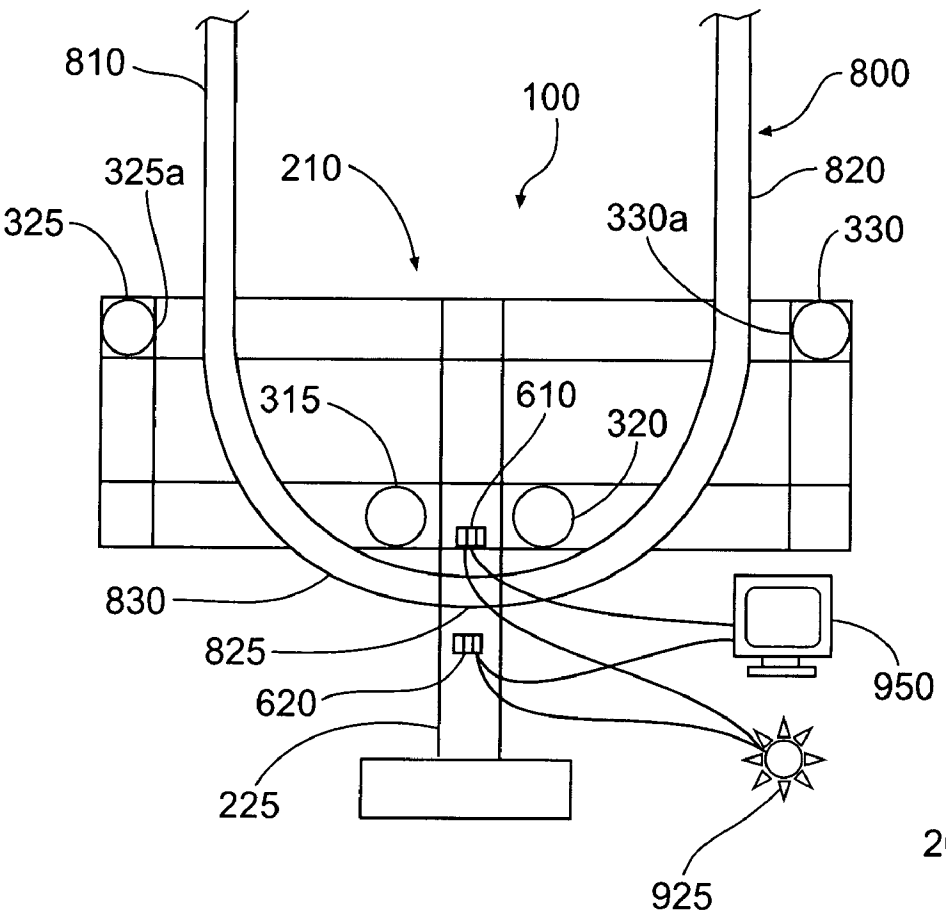
Figure 4B:
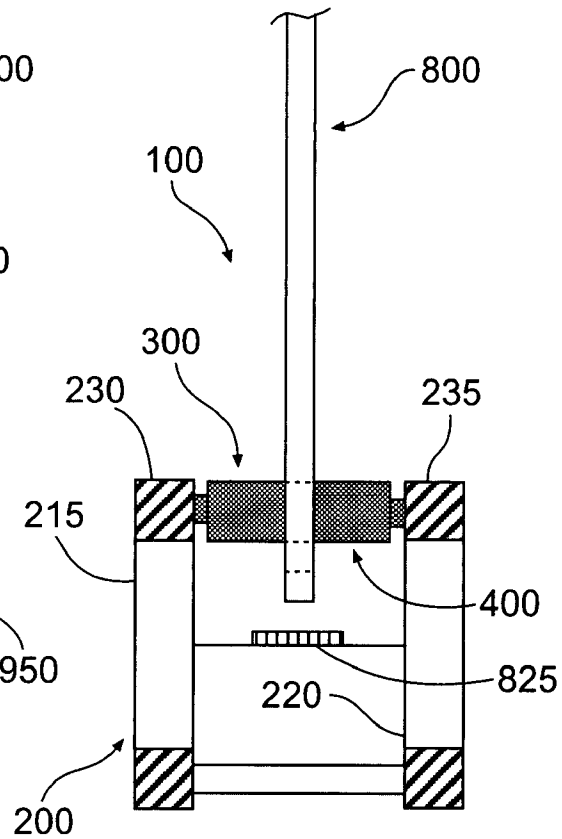
Figure 4A:
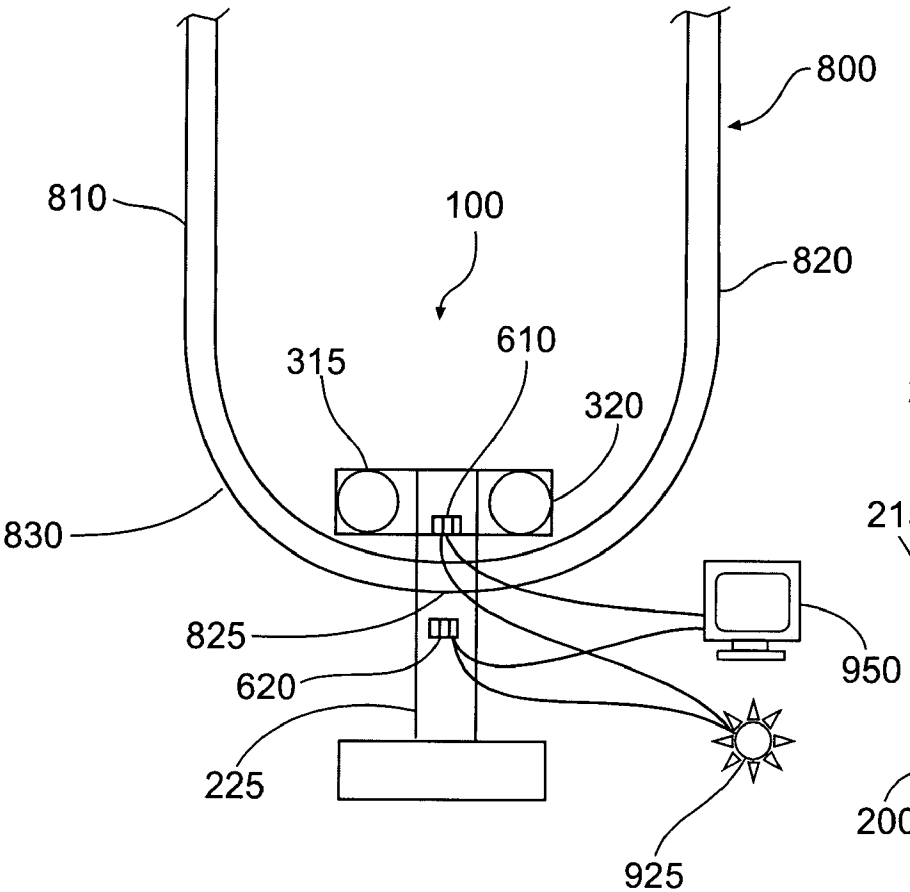

Having thus described the invention in general terms, reference will now be made to the accompanying drawings, which are not necessarily drawn to scale, and wherein:

FIG. 1 is a schematic illustration of an elevator system incorporating a dampening device according to one embodiment of the present invention;

FIGS. 2A, 3A, and 4A are schematic cross-sectional illustrations of representative dampening devices according to embodiments of the present invention; and FIGS. 2B, 3B, and 4B are schematic side view illustrations of the respective representative dampening devices shown in FIGS. 2A, 3A, and 4A.

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

FIG. 1 illustrates a dampening device according to one embodiment of the present invention, such a device being indicated generally by the numeral 100. The dampening device 100 comprises one or more frame members 200 (see, e.g., FIGS. 2B, 3B, 4B), one or more roller members 300 (see, e.g., FIGS. 2B, 3B, 4B), arranged in a first tier and comprising a first guide 400 (see, e.g., FIGS. 2B, 3B, 4B). One embodiment includes one or more roller members 300 arranged in a second tier and comprising a second guide 500. The device 100 also includes one or more sensor devices 600. The device 100 is generally configured to be placed in a pit 700 for an elevator 750 so as to guide and dampen oscillation of a compensating cable 800, wherein the elevator 750 generally includes an elevator car 850 engaged with a counterweight 900 via the compensating cable 800 at respective attachment points 825, 875. Accordingly, the cable 800 includes respective linear portions 810, 820 attached to the elevator car 850 and the counterweight 900 and an arcuate or loop portion 830 (otherwise referred to herein as "the cable loop 830" or "the loop 830") connecting the linear portion 810, 820 in the pit 700. The cable 800 may vary considerably, for example, in cross-sectional size or in cross-sectional shape, such as round or flat, and one skilled in that art will thus appreciate that the radius of the loop 830 may vary considerably and the device 100 must therefore be appropriately sized in response thereto and as generally directed herein.

In some instances, the device 100 may be configured such that the frame members 200 cooperate to provide a compact and relatively short height frame assembly 210, wherein the one or more roller members 300 are attached thereto in different manners, as described further herein. Such a compact configuration is particularly advantageous, for example, in a shallow pit 700, though compactness is generally desirable for any equipment installed in the pit 700 of an elevator 750. For instance, in one embodiment, the uppermost portion of the device 100, namely the second guide 500, when provided, is placed at a height equal to the radius of the cable loop 830 above the bottommost portion 825 of the loop 830, thereby allowing the device 100 to be installed in a shallow pit 700. Such a configuration may be advantageous since there are typically height restrictions on any equipment placed below the counterweight 900 in a shallow pit 700. However, one skilled in the art will appreciate that the configuration and dimensions of the device 100 may vary as necessary due to various factors such as, for example, the size of the cable 800 and the depth or other dimensions of the pit 700.

The frame assembly 210 has at least one, but no more than two, roller members 300 operably engaged therewith, forming the first guide 400, though the number of frame members 200 may vary since each roller member 300 is typically supported at each end thereof. For example, when the device 100 includes, for example, a single roller member 310 forming the first guide 400, the frame assembly 210 may include a pair of opposed vertical frame members 215, 220, as shown in, for example, in FIGS. 2B, 3B, 4B. In instances where the device 100 includes no more than two roller members 315, 320, the frame assembly 210 includes vertical frame members 215, 220 supporting at least a pair of opposed horizontal frame members 230, 235 configured such that the roller members 315, 320 are substantially horizontally spaced apart, as shown in FIGS. 3 and 4. In either instance, the single roller member 310 or the pair of roller members 315, 320 are disposed at or toward the bottommost 825 portion of the loop 830. Preferably, the roller members 300 are disposed adjacent to, but spaced apart from, the cable 800 when the cable 800 is at rest and hanging in a normal configuration. In advantageous instances, the roller members 300 are also disposed with respect to the cable 800 so as to be spaced apart from the from the cable 800 during normal operation of the elevator 750. In this manner, the device 100 will not transfer or apply torsion or other forces to the compensating cable 800, while oscillation or swaying of the cable 800 is minimized and the cable 800 is prevented from moving outside of the guidance and influence of the dampening device 100.

In some instances during operation of the elevator 750, oscillation or swaying of the cable 800 may result. The device 100 is thus configured to dampen such oscillations and to maintain the cable 800 under the influence and guidance of the device 100 during normal operation. However, there may be instances where abnormal conditions cause the elevation of the bottommost portion 825 of the loop 830 to change. For example, the compensating cable 800 may become entangled with equipment in the pit 700 or hoistway and cause the cable 800 to become taut about the first guide 400 and possibly become overloaded or otherwise damaged. Therefore, according to one advantageous aspect of the present invention, the device 100 may further include at least one sensor device 610 disposed within the loop 830 and operably engaged with the frame assembly 210 and/or one of the roller member(s) 310, 315, 320. The at least one sensor device 610 is configured, for example, as a contact sensor, limit switch, proximity sensor, a load sensor, or any other suitable device and, as such, is capable of detecting contact or close proximity of the cable 800 to one of the roller members 310, 315, 320 and/or the at least one sensor 610 itself should the cable 800 become entangled such that the bottommost portion 825 of the loop 830 rises above a normal vertical level. In such instances, the loop 830 may interact with at least one sensor device 610 disposed at or near the single roller member 310, as shown in FIG. 2, or at least one sensor device 610 disposed between the pair of roller members 315, 320, as shown in FIGS. 3 and 4. One skilled in the art will appreciate that, in either instance, the at least one sensor device 610 is disposed so as to be capable of detecting when the cable 800 has reached a selected maximum level of tension so as to avoid damage to the cable 800, to equipment in the pit 700, or otherwise to the elevator 750 or its occupants. The device 100 is thus capable of indicating entanglement of the cable 800 regardless of the directional heading (up or down) of the elevator car 850. The at least one sensor 610, in turn, may be connected to or otherwise in communication with, for example, an alarm device 925 and/or a controller device 950 so as to provide a warning for the abnormal cable condition, such as a siren or other alarm and/or a warning light, and/or perform a desirable response procedure such as, for example, immediately halting the operation of the elevator 750 or stopping the elevator 750 at the next floor in the building.

In other instances, the device 100 may also include at least one sensor device 620 operably engaged with the frame assembly 210 and disposed outside the loop 830 below the bottommost portion 825 thereof, as shown in FIGS. 2–4, in addition to or instead of the at least one sensor device 610 within the loop 830. The at least one sensor device 620 may also configured, for example, as a contact sensor, limit switch, proximity sensor, a load sensor, or any other suitable device, capable of detecting contact or close proximity of the cable 800 thereto should, for instance, the bottommost portion 825 of the cable loop 830 sag below a normal vertical level toward the floor of the pit 700 due to, for example, stretching of the hoist or suspension rope 650. One skilled in the art will appreciate that the at least one sensor device 620 is disposed so as to be capable of detecting when the cable 800 has reached a selected maximum level of sag so as to avoid damage to the cable 800 or otherwise to the elevator 750 or its occupants by the loop 830 dragging on the floor of the pit 700. Potential entanglement of the cable 800 may also be avoided by early detection of this abnormal condition. As before, the at least one sensor 620 may also be connected to or otherwise in communication with, for example, an alarm device 925 and/or a controller device 950 so as to provide a warning for the abnormal cable condition, such as a siren or other alarm and/or a warning light, and/or perform a desirable response procedure such as, for example, immediately halting the operation of the elevator 750 or stopping the elevator 750 at the next floor in the building.

Other advantageous embodiments of the present invention may further include a second guide 500 disposed at a discrete level above the first guide 400. Such a second guide 500 includes a pair of opposed horizontal frame members 240, 245 operably engaged with the one or more vertical frame member(s) 215, 220, as shown in FIGS. 2 and 3. The second guide 500 further includes at least one pair of roller members 325, 330 engaged with the horizontal frame members 240, 245 and disposed outside the cable loop 830 and the linear portions 810, 820. In one embodiment, the roller members 325, 330 are disposed outside vertical projections 815, 825 of the respective linear portions 810, 820 of the cable 800 and spaced apart therefrom such that contact between the cable 800 and the roller members 325, 330 is generally avoided during operation of the elevator 750. As such, the portion of each roller member 325, 330 closest to the cable 800 comprises the inner guide surface 325*a*, 330*a* of the respective roller member 325, 330. Further, in instances where the second guide 500 includes only the outside roller members 325, 330, the roller members 325, 330 are substantially horizontally spaced apart and vertically spaced by at least the radius of the loop 830 above the bottommost portion 825 of the loop 830. The roller members 325, 330 of the second guide 500 thus function, for example, to contain the widening of the cable loop 830 due to centrifugal force that occurs during operation of the elevator 750.

In some instances, the second guide 500 may also include a pair of roller members 335, 340 operably engaged with the horizontal frame members 240, 245 and disposed within the cable loop 830/linear portions 810, 820 adjacent to, but spaced apart from the cable 800 such that contact between the cable 800 and the roller members 335, 340 is generally avoided during operation of the elevator 750 so as not to transfer or apply torsion or other forces to the cable 800. The portion of each roller member 325, 330 furthest from the cable 800 comprises the inner guide surface 335*a*, 340*a* of the respective roller member 335, 340. The inside roller members 335, 340 may be provided in the second guide 500 so as to, for example, guide the cable 800 and/or prevent binding of the cable 800 about the first guide 400 by keeping the linear portions 810, 820 spaced apart should an entanglement condition occur.

In instances where the second guide 500 comprises the outside roller members 325, 330 and the first guide 400 comprises the pair of roller members 315, 320 within the loop 830, the roller members 315, 320 within the loop 830 are horizontally spaced apart by no more than half the distance between the inner guide surfaces 325*a*, 330*a* of the outside roller members 325, 330 of the second guide 500, respectively. However, in instances (not shown) where the second guide 500 comprises the outside roller members 325, 330 and the inside roller members 335, 340, and the first guide 400 comprises the pair of roller members 315, 320 within the loop 830, the roller members 315, 320 within the loop 830 are horizontally spaced apart by no more than half the distance between the inner guide surfaces 335*a*, 340*a* of the inside roller members 335, 340 of the second guide 500, respectively.

As described herein, embodiments of the dampening device 100 may also be considered as a "loop height detector" for detecting abnormal or hazardous conditions indicated by variations in the vertical height of the bottommost portion 825 of the compensating cable 800. Accordingly, embodiments of the device 100 may supplement or replace the safety loop 1000 engaged underneath the elevator car 850 in typical installations by advantageously early and immediate warning of abnormal or unsafe compensating cable conditions and preventing such conditions from causing damage to the cable 800, damage to equipment in the elevator hoistway and pit, and/or injury to occupants of the elevator car 850.

Many modifications and other embodiments of the inventions set forth herein will come to mind to one skilled in the art to which these inventions pertain having the benefit of the teachings presented in the foregoing descriptions and the associated drawings. For example, the device 100, in some instance, may also be applied as an anti-rebound device for preventing the hoist or suspension rope 650 from jumping off the traction sheave during sudden, emergency stops, including buffer engagement. Further, advantages may be realized by variance of the horizontal spacing between roller members 300 or, for instance, the material, length, diameter, and color of the roller members 300. In addition, advantages may also be realized from varying the number, location, or configuration of the sensor device(s) 600, as well as the configuration, shape, or strength of the frame members 200, the first guide 400, the second guide 500, or the frame assembly 210. One skilled in the art may also appreciate that the configuration of the dampening device 100 may also vary considerably. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A dampening device for a compensating cable operably engaged with an elevator car, the compensating cable having two linear portions connected by an arcuate portion, said device comprising:

a stationary first guide including at least one roller member stationarily disposed within the arcuate portion, the first guide being configured to dampen oscillation of the compensating cable; and at least one sensor device disposed within the arcuate portion and configured to be capable of sensing at least one of vertical movement of the acurate portion of the compensating cable independently of the at least one roller member and contact between the compensating cable and the at least one roller member, the at least one sensor device thereby being configured to sense an entanglement condition of the compensating cable.

2. A device according to claim 1 further comprising at least one sensor device disposed outside the arcuate portion and configured to be capable of sensing vertical movement of the arcuate portion of the compensating cable independently of the at least one roller member, the at least one sensor device thereby being configured to sense a suspension rope stretch condition.

3. A device according to claim 1 wherein the at least one roller member further comprises no more than two roller members horizontally spaced apart within the arcuate portion of the compensating cable.

4. A device according to claim 1 further comprising a second guide disposed above the first guide and configured to guide the compensating cable.

5. A device according to claim 4 wherein the second guide further comprises a first pair of roller members, each roller member being disposed outside of a vertical extension of the respective linear portion of the compensating cable and defining an inner guiding surface.

6. A device according to claim 5 wherein the second guide further comprises a second pair of roller members disposed within a vertical extension of the respective linear portion of the compensating cable.

7. A device according to claim 5 wherein, when the first guide comprises two roller members horizontally spaced apart within the arcuate portion of the compensating cable, the two roller members of the first guide are horizontally spaced apart by no more than half of a distance between the inner guide surfaces of the first pair of roller members of the second guide.

8. A device according to claim 1 wherein the at least one sensor device is selected from the group consisting of a contact switch, a limit switch, a proximity sensor, and a load sensor.

9. A device according to claim 1 wherein the at least one sensor device is further configured to be in communicate the sensed condition with at least one of an alarm device and a control device.

10. An elevator system, comprising:

an elevator car;

a counterweight;

a compensating cable operably engaged with the elevator car and the counterweight and having two linear portions connected by an arcuate portion; and a dampening device, comprising:

a stationary first guide including at least one roller member stationarily disposed within the arcuate portion, the first guide being configured to dampen oscillation of the compensating cable; and at least one sensor device disposed within the arcuate portion and configured to be capable of sensing at least one of vertical movement of the acurate portion of the compensating cable independently of the at least one roller member and contact between the compensating cable and the at least one roller member, the at least one sensor device thereby being configured to sense an entanglement condition of the compensating cable.

11. A system according to claim 10 wherein the dampening device further comprises at least one sensor device disposed outside the arcuate portion and configured to be capable of sensing vertical movement of the arcuate portion of the compensating cable independently of the at least one roller member, the at least one sensor device thereby being configured to sense a suspension rope stretch condition.

12. A system according to claim 10 wherein the at least one roller member further comprises no more than two roller members horizontally spaced apart within the arcuate portion of the compensating cable.

13. A system according to claim 10 wherein the dampening device further comprises a second guide disposed above the first guide and configured to guide the compensating cable.

14. A system according to claim 13 wherein the second guide further comprises a first pair of roller members, each roller member being disposed outside of a vertical extension of the respective linear portion of the compensating cable and defining an inner guiding surface.

15. A system according to claim 14 wherein the second guide further comprises a second pair of roller members disposed within a vertical extension of the respective linear portion of the compensating cable.

16. A system according to claim 14 wherein, when the first guide comprises two roller members horizontally spaced apart within the arcuate portion of the compensating cable, the two roller members of the first guide are horizontally spaced apart by no more than half of a distance between the inner guide surfaces of the first pair of roller members of the second guide.

17. A system according to claim 10 wherein the at least one sensor device is selected from the group consisting of a contact switch, a limit switch, a proximity sensor, and a load sensor.

18. A device according to claim 10 wherein the at least one sensor device is further configured to communicate the sensed condition with at least one of an alarm device and a control device.

19. A method for guiding a compensating cable operably engaged with an elevator car, the compensating cable having two linear portions connected by an arcuate portion, said method comprising:

guiding the compensating cable about a first guide stationarily disposed within the arcuate portion, the first guide including at least one stationarily disposed roller member and being configured to dampen oscillation of the compensating cable; and detecting an entanglement condition of the compensating cable with at least one sensor device disposed within the arcuate portion and configured to be capable of sensing at least one of vertical movement of the arcuate portion of the compensating cable independently of the at least one roller member and contact between the compensating cable and the at least one roller member.

20. A method according to claim 19 further comprising detecting a suspension rope stretch condition with at least one sensor device disposed outside the arcuate portion and configured to be capable of sensing vertical movement of the arcuate portion of the compensating cable independently of the at least one roller member.

21. A method according to claim 19 wherein guiding the compensating cable with a first guide further comprises guiding the compensating cable about no more than two roller members comprising the first guide, the no more than two roller members being horizontally spaced apart within the arcuate portion of the compensating cable.

22. A method according to claim 19 further comprising guiding the compensating cable with a second guide disposed above the first guide.

23. A method according to claim 22 wherein guiding the compensating cable with a second guide further comprises guiding the compensating cable with a first pair of roller members comprising the second guide, each roller member being disposed outside of a vertical extension of the respective linear portion of the compensating cable and defining an inner guiding surface.

24. A method according to claim 23 wherein guiding the compensating cable with a second guide further comprises guiding the compensating cable with a second pair of roller members disposed within a vertical extension of the respective linear portion of the compensating cable.

25. A method according to claim 23 wherein, when the first guide comprises two roller members horizontally spaced apart within the arcuate portion of the compensating cable, guiding the compensating cable with the first guide further comprises guiding the compensating cable with the first guide having the two roller members horizontally spaced apart by no more than half of a distance between the inner guide surfaces of the first pair of roller members of the second guide.

26. A method according to claim 19 further comprising communicating the sensed condition from the at least one sensor device to at least one of an alarm device and a control device.

27. A dampening device for a compensating cable operably engaged with an elevator car, the compensating cable having two linear portions connected by an arcuate portion, said device comprising:

a stationary first guide including at least one roller member stationarily disposed within the arcuate portion, the first guide being configured to dampen oscillation of the compensating cable; and at least one sensor device disposed within the arcuate portion and configured to be capable of sensing vertical movement of the acurate portion of the compensating cable independently of the at least one roller member, the at least one sensor device thereby being configured to sense a suspension rope stretch condition.

28. A dampening device for a compensating cable operably engaged with an elevator car, the compensating cable having two linear portions connected by an arcuate portion, said device comprising:

a stationary first guide including at least one roller member stationarily disposed within the arcuate portion, the first guide being configured to dampen oscillation of the compensating cable;

at least one sensor device disposed within the arcuate portion and configured to be capable of sensing at least one of vertical movement of the arcuate portion of the compensating cable independently of the at least one roller member and contact between the compensating cable and the at least one roller member, the at least one sensor device disposed within the arcuate portion thereby being configured to sense an entanglement condition of the compensating cable; and at least one sensor device disposed outside the arcuate portion and configured to be capable of sensing vertical movement of the arcuate portion of the compensating cable independently of the at least one roller member, the at least one sensor device disposed outside the arcuate portion thereby being configured to sense a suspension rope stretch condition.

* * * * *

UNITED STATES PATENT AND TRADEMARK OFFICE

CERTIFICATE OF CORRECTION

PATENT NO. : 7,117,978 B2
APPLICATION NO. : 10/915245
DATED : October 10, 2006
INVENTOR(S) : Kaczmarek et al.

It is certified that error appears in the above-identified patent and that said Letters Patent is hereby corrected as shown below:

Column 10,

Line 13, "within" should read --outside--.

Signed and Sealed this

Twenty-seventh Day of February, 2007

JON W. DUDAS
*Director of the United States Patent and Trademark Office*